US007377396B2

(12) United States Patent
Keen

(10) Patent No.: US 7,377,396 B2
(45) Date of Patent: May 27, 2008

(54) GARMENT HANGER CADDY AND STORAGE RACK THEREFOR

(76) Inventor: Cletus F. Keen, 2736 S. Punta Del Este, Hacienda Heights, CA (US) 91745

( * ) Notice: Subject to any disclaimer, the term of this patent is extended or adjusted under 35 U.S.C. 154(b) by 342 days.

(21) Appl. No.: 11/082,730

(22) Filed: Mar. 18, 2005

(65) Prior Publication Data

US 2006/0207949 A1 Sep. 21, 2006

(51) Int. Cl.
*A47F 7/00* (2006.01)

(52) U.S. Cl. ..... 211/49.1

(58) Field of Classification Search ..... 211/49.1, 211/13.1, 85.3, 54.1, 85.31, 181.1
See application file for complete search history.

(56) References Cited

U.S. PATENT DOCUMENTS 3,692,188 A * 9/1972 Bayne ..... 211/59.4
4,016,981 A * 4/1977 Hildt ..... 211/49.1
4,424,905 A * 1/1984 Keen ..... 211/49.1
4,627,672 A 12/1986 DeBruyn ..... 312/331
4,768,658 A * 9/1988 Shafto ..... 211/49.1
5,924,578 A * 7/1999 McKenzie ..... 211/49.1
6,431,375 B2 * 8/2002 Spencer ..... 211/106
6,520,349 B2 2/2003 Keen

FOREIGN PATENT DOCUMENTS

SE 000670194 5/1989

* cited by examiner

*Primary Examiner*—Sarah Purol
(74) *Attorney, Agent, or Firm*—Jacobson Holman PLLC

(57) ABSTRACT

A hanger fixture that supports a hanger hook and includes a glide rod and two guide rods to loosely hold the hanger hook in a predetermined position on the hanger fixture. A secure wire spaced from the glide rod and connected to the glide rod helps hold the hanger hook in place. The assembly of the glide rod and secure wire are adjustable in position over four different settings each ⅜ inches apart.

16 Claims, 6 Drawing Sheets

GARMENT HANGER CADDY AND STORAGE RACK THEREFOR

FILED OF THE INVENTION

The present invention relates to a hanger caddy operable for storing hangers and for easy access of stored hangers under a counter top of a retail establishment.

BACKGROUND OF THE INVENTION

Millions of plastic garment hangers are removed from clothing each day at point-of-sale in retail stores. These hangers must be dealt with in the back rooms of the stores through a process of untangling, sorting by style and organizing them for re-use. This is a serious problem because of labor intensiveness, cost of broken hangers ($0.25 to $1.00 each) due to tangle, storage space and retail efficiency. In addition, new federal and state regulations against discarding plastic hangers into the nation's landfills, makes recycling for all retail stores a necessity.

Successful hanger management is thwarted by the multiplicity of hanger styles used in retail stores. Previous attempts to sort and organize all hangers have failed because no one hanger management system will accept and sort all hangers.

At present, to sort hangers, boxes of various materials and sizes are used at point of sale. Hangers removed by sales clerks are thrown into these boxes. When full, the boxes of hangers are removed to the back of the retail establishment, the hangers manually untangled and sorted for re-use. This method is the most frequently used system and the most costly from the standpoint of labor costs, efficiency and broken hanger expense.

One system attempting to deal with this problem includes a hair-pin fixture sorting method using a metal fixture consisting of two metal hoops, one shorter than the other. The hanger hook is placed in the tallest hoop and hanger arms are placed between the two hoops. This method makes no attempt to align hooks or separate hooks by style. This system is only slightly superior to the box sorting method because of tangling of hangers, broken hangers still exist and re-sorting is still necessary.

Another system includes a bar sorting assembly having three to six bars approximately 24 inches long. Each bar is designated for a specific hanger type and sortation results to some degree, dependent completely on employee discipline. In operation, serious problems develop if foam rubber hold downs unlock in which case all hangers can fall off the bars during transfer from a bar rack at a point of sale to a rolling rack for transfer to a back room. Bars must be held horizontal and hangers tend to swing out of alignment and frustrate easy loading on rolling racks. This system is the most expensive hanger management system mainly because it has a very elaborate racking system required to hold hangers and its many plastic pieces and foam rubber parts that require replacement.

It has been determined that the critical distance for a hanger is the center of the hanger hook to the shoulders or arms of the hanger. Since this distance varies by style, retail chain dedicated hangers and manufacturer, a number of hanger fixtures are required and designed to accept each particular hanger type. This clearly is unacceptable, costly, confusing and unworkable because of space requirements.

Hanger standardization then would seem to be the only real solution; however, this solution would have to be accepted industry-wide. This apparently will not happen in view of the large investment in the present inventory of retail hangers which would have to be scrapped and replaced with new standardized hangers at a substantial cost. Since the problem remains, the problem to be solved must be how to bring order and efficiency to the tangle and confusion of the costly hanger management problem.

SUMMARY OF THE INVENTION

A detailed examination of the multiplicity of hanger styles reveals a startling consistency in the midst of all this confusion. The swivel metal hook on the garment hanger, on 99 percent of all hangers, is standardized.

With this fact in mind, the present invention provides an improvement over my U.S. Pat. No. 6,520,349, hereby incorporated by reference in its entirety, and includes a fixture that supports the hanger hook and includes a glide rod and two guide rods to loosely hold the hanger hooks in a predetermined position on the hanger stacker fixture. A secure wire spaced from the glide rod and connected to the glide rod helps hold the hanger hooks in place. The assembly of the glide rod and secure wire are adjustable in position over four different settings each ⅜ inches apart.

The hanger caddy of the present invention allows hangers to be sorted by style if desired or to be used for acceptance of all styles on one caddy fixture. In the later instance, the various hanger styles can easily be removed from the fixture by reversing the direction of the hangers from that used to load the hanger caddy.

The present invention is designed to accept all garment hangers for the purpose of collecting, organizing and sorting garment hangers for efficient recycling and re-use. These hangers include plastic and metal hangers as well as wood hangers which use a swivel metal hook. Most non-swivel hangers are also accommodated.

The present invention is essentially an efficient hanger management system for both small and large clothing stores and chain stores. Since no other system now offers this capability, this system is truly unique.

The metal fixture of the present invention consists of ⅝ inch metal rod construction through-out, except for the secure wire which is made of #6 bar or wire stock. The base is configured in a pie-shape to allow four fixtures to occupy approximately a 15 inch by 15 inch space which is very space efficient for a retail store when the hanger caddies are in a vertical orientation.

Two upwardly extending, parallel vertical guide rods extend from the base providing support and stability to the fixture. The guide rods guide the arms of the hanger, whereas the glide rod and secure wire guide the hook of the hanger.

The glide rod located between the two guide rods, extends 29 inch vertically from the base. The top 4½ inches of the glide rod become the "neck" of the fixture, providing a projection for the hook of the hanger to easily grab or hook the "glide" rod which after release of the hanger by the employee glides down to the base with the arms of the hanger contacting the guide rods when the hanger caddy is in a vertical or inclined orientation.

The secure wire and the glide rod extend for a major portion substantially parallel to each other at a separation distance of approximately ¼ to ½ inch and preferably ⅜ inch. Opposite ends of the secure wire are attached to the glide rod. The opposite ends of the glide rod are slidably secured to the base at a bottom end and the guide rods at an upper end, respectively, for sliding adjustment of the separation distance between the guide rods and the glide rod. The need to vary this separation distance allows accommodation of different sized hangers. The separation distance may be set at a factory and welded or bolted in place to maintain the separation distance according to a predetermined need of a particular retail establishment.

The top of the glide rod bends back parallel and downwardly for 4½ inches. The glide rod is then bent at a 90 degree angle and is slidably secured to the guide rods.

The two guide rods, extend upwardly from the base for approximately 25½ inches at a separation distance of five inches. The guide rods then bend 90 degrees and form a hoop encircling the glide rod.

To operate the system of the present invention, at the point of sale, a hanger is removed from a garment. The employee takes the hanger by the arm and hooks the hook of the hanger around the projecting neck of the glide rod and releases the hanger. The hanger hook glides down between the glide rod and the secure wire to the base along an inclined hanger caddy.

The hanger caddy can be used mounted on a rack assembly located below a cash register of a store. The rack assembly holds the caddy fixture at an approximate 18 degree angle allowing the hanger hook to be placed on the "neck" of the glide rod and released to have the hanger glide down slowly by gravity down to the base of the fixture. The gravity feed feature of the present invention provides for a simple fixture with no complicated moving or replaceable parts.

In this operating mode, the hanger caddy is at an angle of approximately 15 to 18 degrees and is mounted by a rack assembly under the cash-wrap counter. The neck of the caddy extends beyond the edge of the counter allowing hanger hooks to be placed on the neck of the glide rod and lets hangers glide down to the base.

The rack assembly includes a base and a tray slidably mounted on the base. A vertically extending wall anchored on the tray by swivel brackets elevates the vertical wall above the tray. The vertical wall includes at least two sets of clips or holders for supporting the hanger caddy on the vertical wall with the hanger caddies mounted on the vertical wall of the tray. The entire tray is slidable on the base out from under the cash register counter. The hanger caddies may thereby be easily lifted and removed from the vertical wall for subsequent transport.

The vertical wall is foldable down onto the tray in a collapsed position. In the collapsed position, the assembly has a height of four inches to aid in minimizing shipping costs.

It is an object of the present invention to provide a garment hanger caddy that is capable of accepting all types of hangers and holding the hangers in an aligned position.

It is still yet another object of the present invention to align a plurality of hanger caddies at an angle of between approximately 15 to 18 degrees with respect to a vertical wall.

It is still yet another object of the present invention to provide a garment hanger caddy having two parallel extending guide rods laterally spaced from a glide rod and a secure wire attached to opposite ends of the glide rod.

It is still yet another object of the present invention to provide a garment hanger caddy having two parallel extending guide rods laterally spaced from a glide rod and a secure wire attached to opposite ends of the glide rod with the interconnected glide rod and secure wire being slidably mounted on a base of the hanger caddy and the guide rods to adjust a separation distance between the interconnected glide rod and secure wire from the two guide rods.

It is still yet another object of the present invention to provide a garment hanger caddy having two parallel extending guide rods laterally spaced from a glide rod and a secure wire attached to opposite ends of the glide rod with the interconnected glide rod and secure wire being slidably mounted on a base of the hanger caddy and the guide rods to adjust a separation distance between the interconnected glide rod and secure wire from the two guide rods with the hanger caddy being mounted on a vertical wall of a rack assembly located below a counter of a retail establishment and the rack assembly allowing lateral movement of the vertical wall for withdrawal of the hanger caddy from underneath the counter top.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
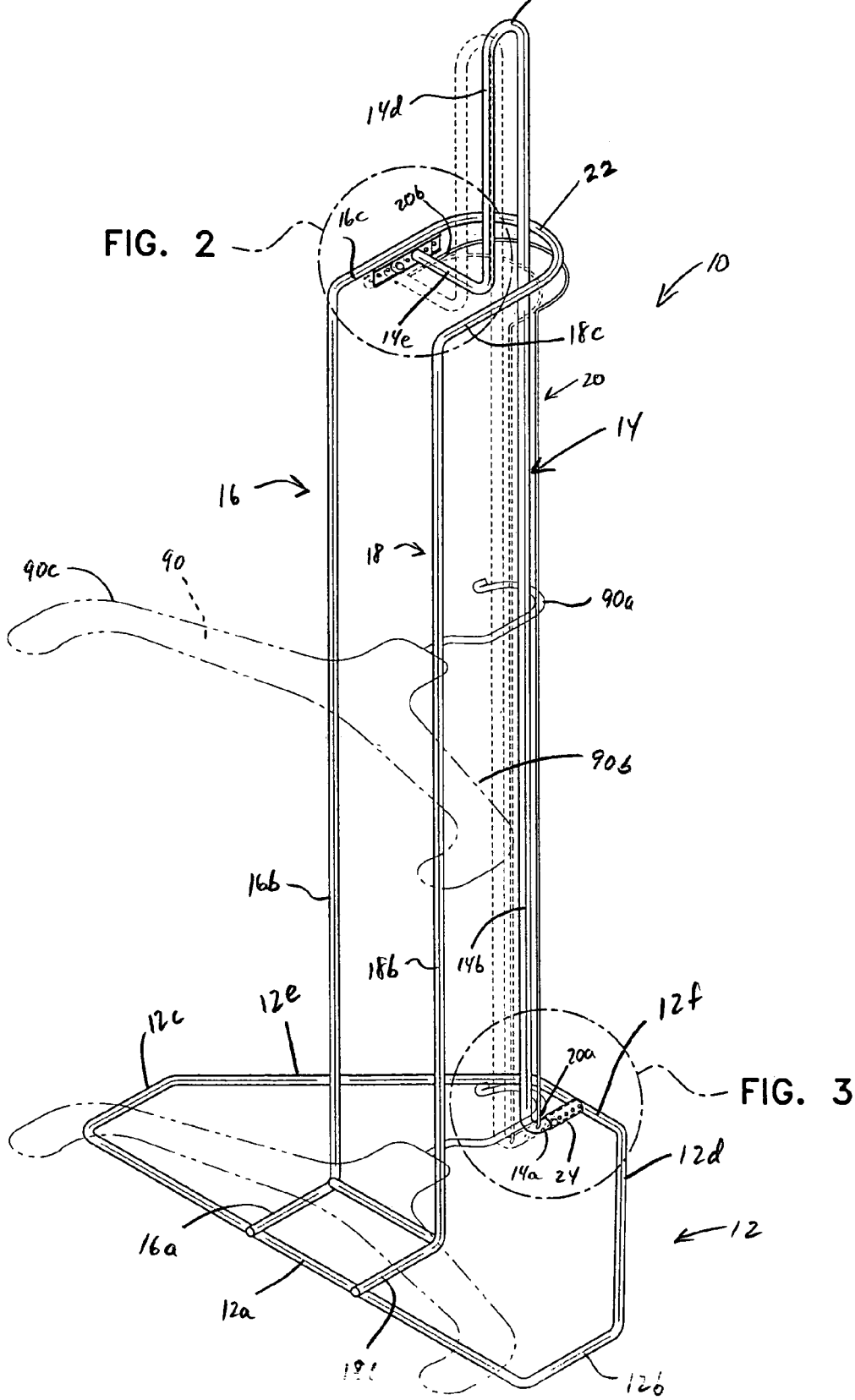
FIG. 1 is a perspective view of the garment hanger caddy of the present invention showing the placement of a plurality of hangers with the hook of the hangers sliding between a glide rod and a secure wire with the arms of the hanger being positioned against two guide rods, the two guide rods being located on opposite sides of the glide rod.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to-the drawings, in general, and to FIGS. 1 through 4, in particular, a garment hanger caddy embodying the teachings of the subject invention is generally designated as 10. With reference to its orientation in FIG. 1, the garment hanger caddy includes a pie shaped base 12, a glide rod 14, left side guide rod 16, right side guide rod 18 and a secure wire 20.

In FIG. 1, the base 12 is made of a welded-rod including section 12*a* of approximately 9¼ inches in length, section 12*b* and 12*c* of approximately 1¾ inches in length, sections 12*d* and 12*e* of approximately six inches in length and section 12*f* of approximately three inches in length. The dimensioning of the base allows four caddys to nest together in an approximately 15 by 15 inch space to conserve space so as to save shipping and manufacturing costs.

Extending inwardly from section 22*a* of the base 22 are sections 16*a* and 18*a* of guide rods 16 and 18, respectively which then turn 90 degrees to form section 16*b* and 18*b* extending to a height of 25½ inches above base 12. Section 16*c* and 18*c* then turn 90 degrees with respect to section 16*b* and 18*b* and terminate in hoop shaped section 22 interconnecting sections 16*c* and 18*c*.

With respect to the glide rod 14, section 14*a* slidably extends within a hollow sleeve 24 projecting from base section 12*f* and then turns 90 degrees to travel vertically, by section 14*b* to a height of approximately 29 inches. The glide rod turns on itself by U-shaped section 14*c*, traveling downwardly for a distance of approximately 4½ inches through section 14*d* and then turning 90 degrees through section 14*e* which is slidably secured to section 16*c* of left side guide rod 16.

Figure 3:
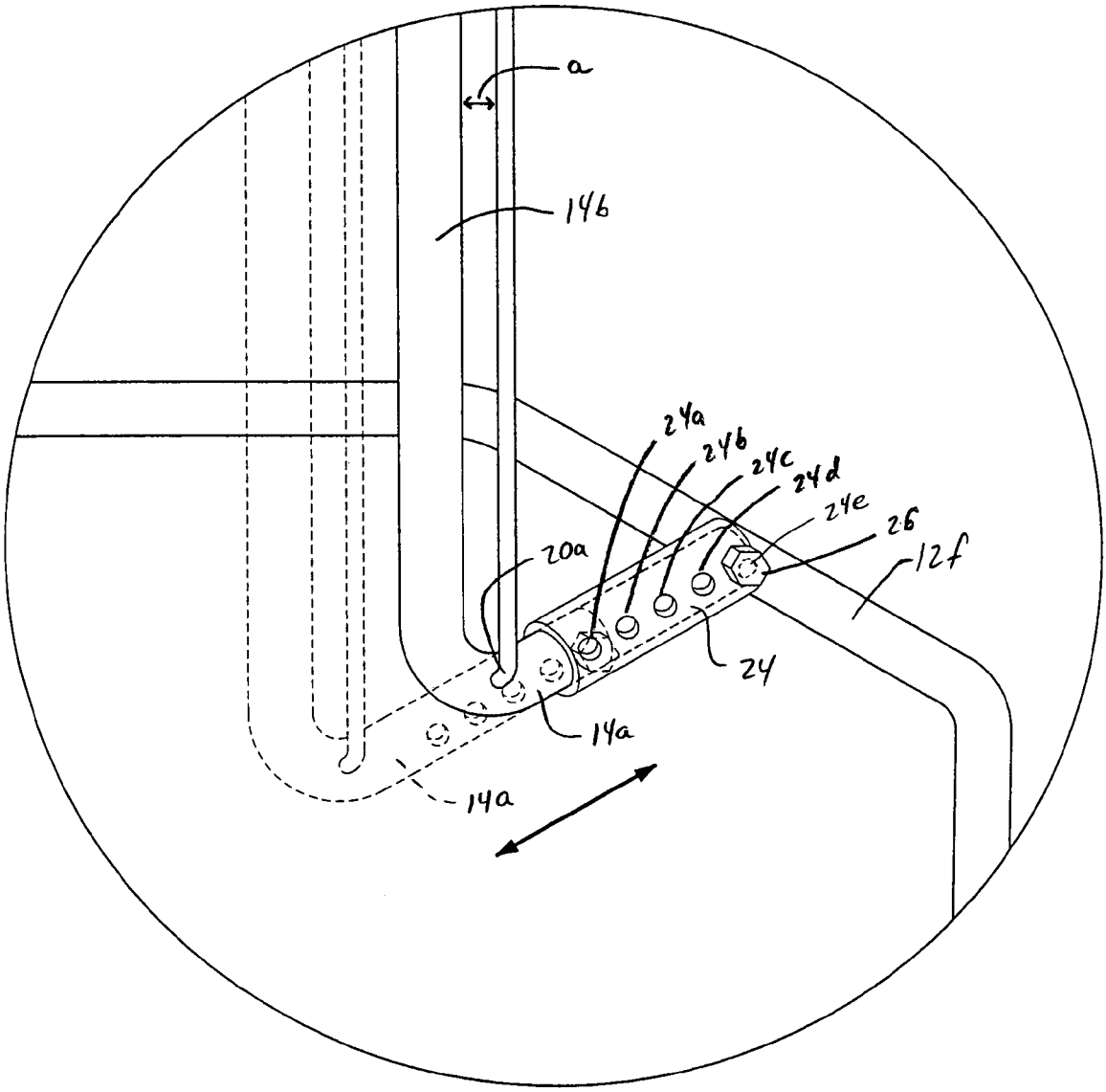
FIG. 3 is an enlarged detailed view of the area encircled in FIG. 1 and labeled as FIG. 3.

The secure wire 20 is secured at a lower end 20*a* to section 14*a* of the glide rod 14 as shown in FIG. 3. At an opposite upper end 20*b*, the secure wire is secured to section 14*e* of the glide wire 14. As such, movement by the glide wire provides similar movement of the secure wire with the spacing between the glide rod 14 and secure wire 20 being maintained at a constant separation. Separation distance "a", as shown in FIG. 3, is fixed in a range of between ¼ and ½ inch. However, the separation distance between the glide rod and the guide rods is varied by movement of section 14*a* and 14*e* of the glide rod with respect to the fixed guide rods 16, 18.

As shown in greater detail in FIG. 3, the sleeve 24 includes five holes 24*a* through 24*e* which are separated by ⅜ inches between each-successive hole. Similarly, section 14*a* has a plurality of holes through which a bolt 26 may extend through one of the holes in the sleeve 24 and into a threaded hole in the section 14*a* of the glide rod 14. Thereby, by sliding section 14*a* into and out of the sleeve 24 and securing the section 14*a* by the bolt 26, the position of the section 14*a* and thereby the glide rod 14 may be made to move closer or away from the guide rods 16, 18.

Figure 2:
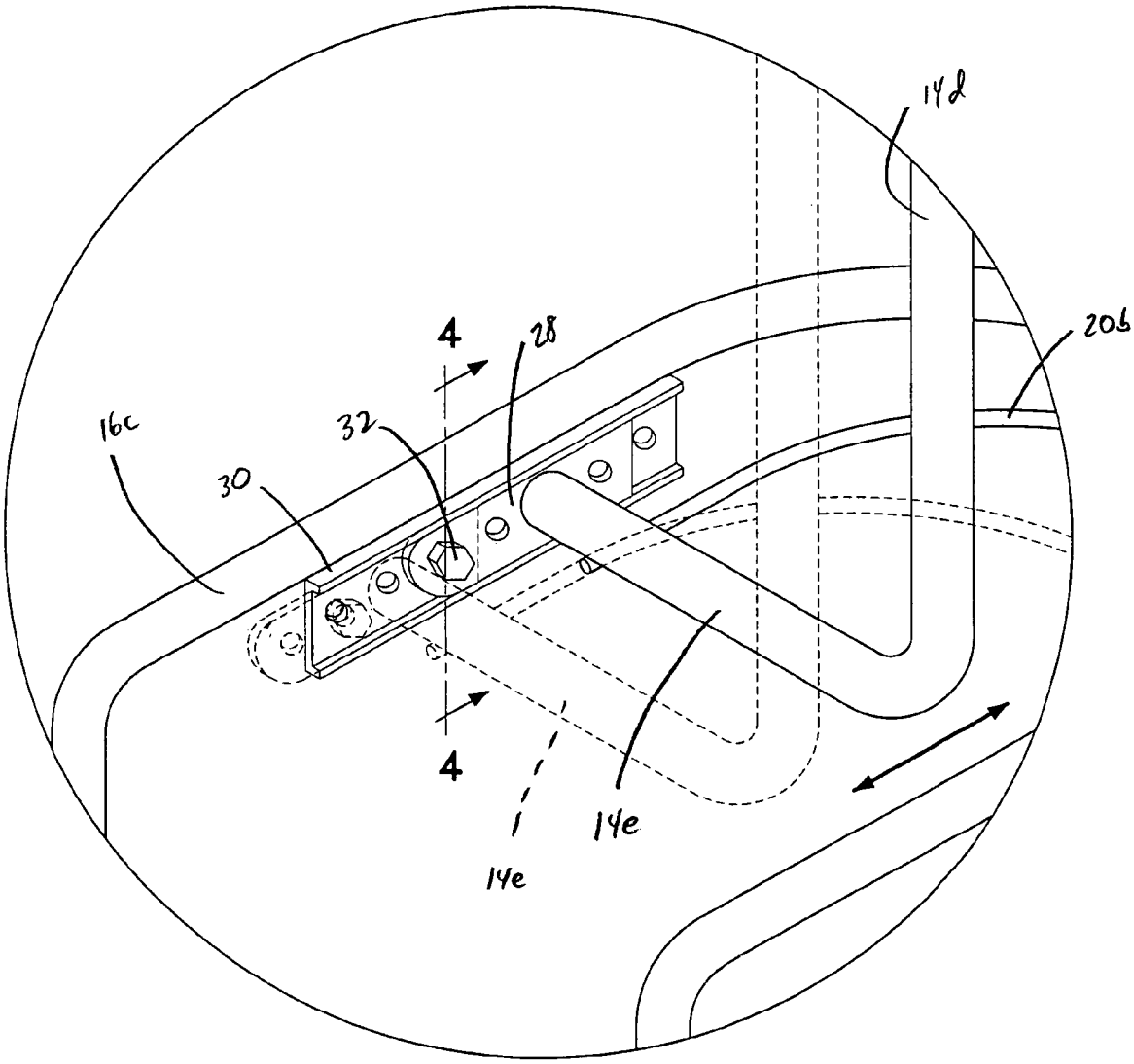
FIG. 2 is an enlarged detailed view of the area encircled in FIG. 1 and labeled as FIG. 2.
Figure 4:
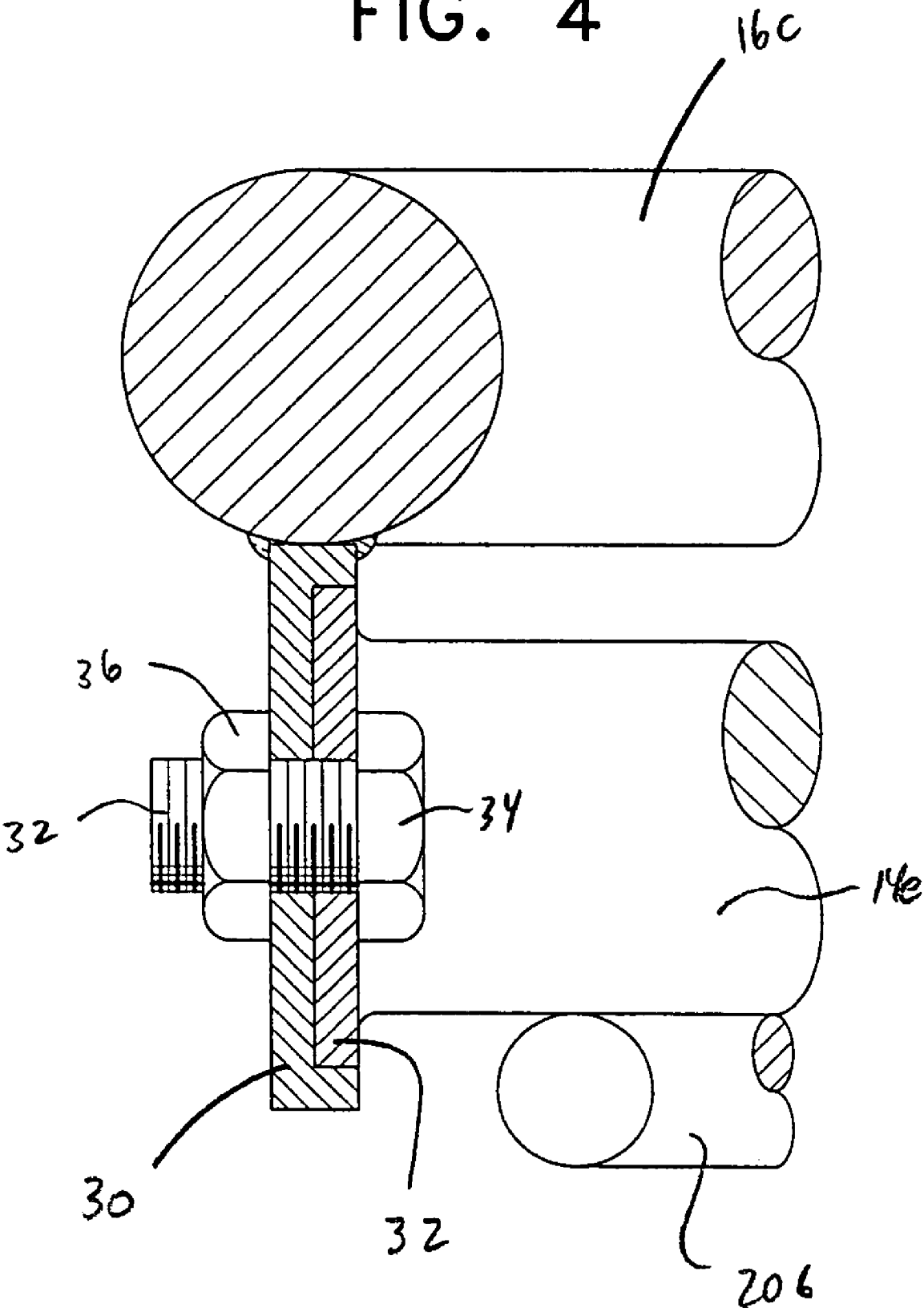
FIG. 4 is a sectional view taken along line 4-4 of FIG. 2.

At the opposite end, section 14*e* of glide rod 14, as shown in FIG. 2, terminates in plate 28 having a plurality of holes. The plate 28 is slidably mounted within C-shaped channel 30 which is secured to section 16*c* of guide rod 16. By use of a bolt 32, the relative positioning of section 14*e* of the glide rod may be changed to provide a parallel adjustment of the spacing between the glide rod and secure wire assembly with respect to the two guide rods as is similarly adjusted at section 14*a* of the glide rod. In FIG. 4, the bolt 32 is shown extending through the plate 32 and C-shaped section 30 as driven by rotation of the head 34 of the bolt and secured by nut 36 on the bolt 32.

Figure 5:
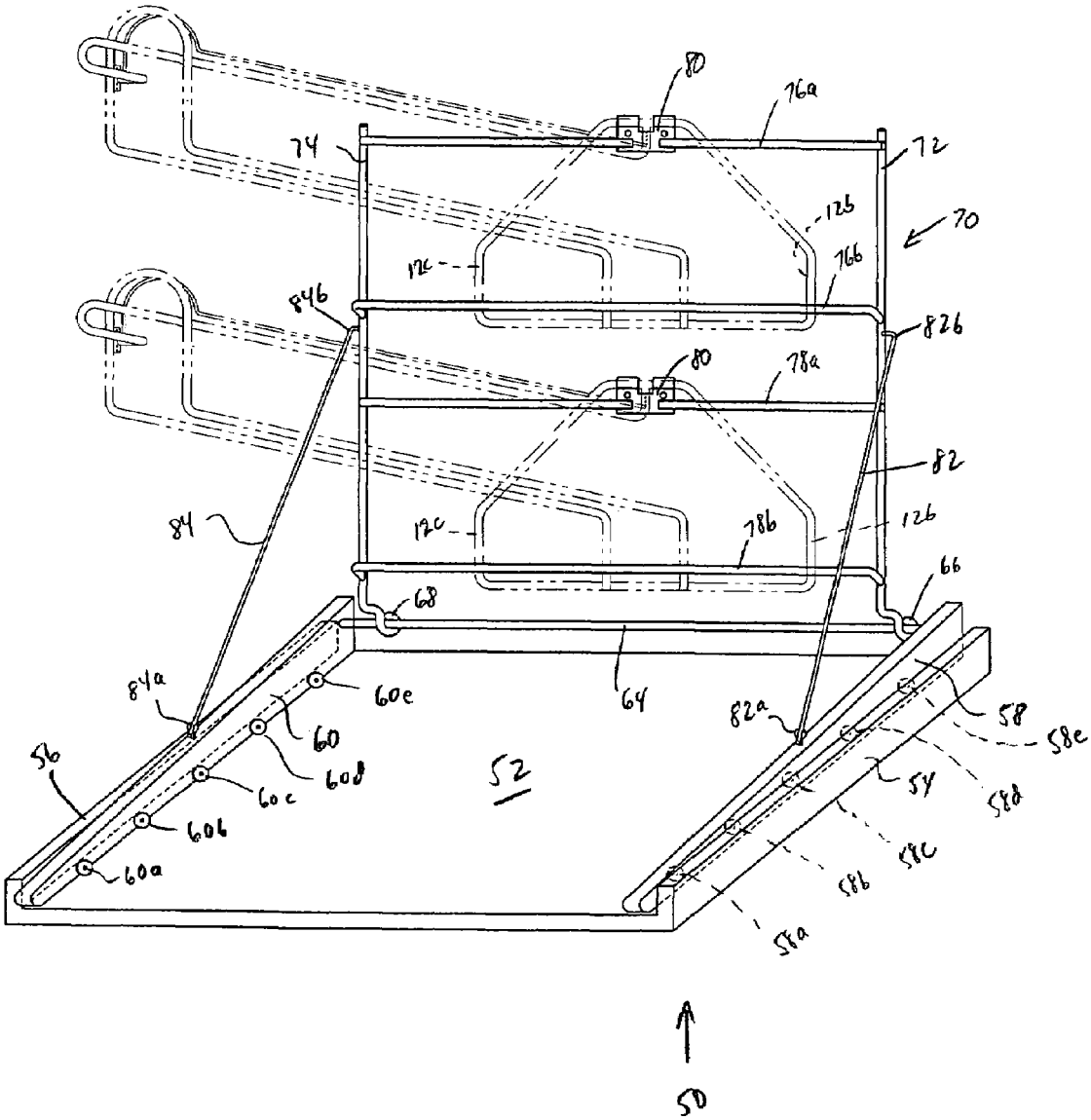
FIG. 5 is a perspective view of the rack assembly of the present invention with two hanger caddies removably mounted on a vertical wall of the rack assembly.
Figure 6:
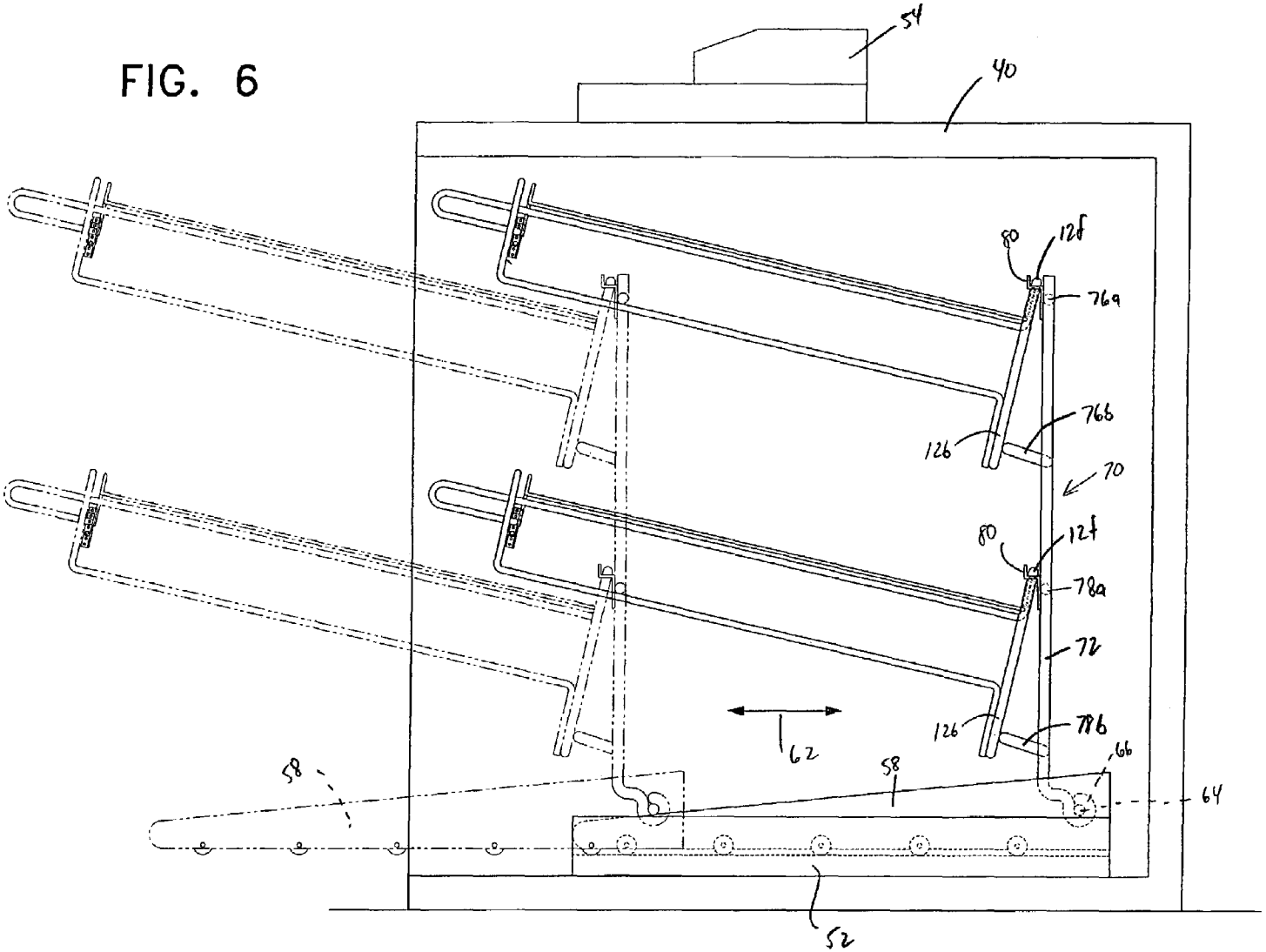
FIG. 6 schematically illustrates two hanger caddies mounted on the vertical wall of the rack assembly, as shown in solid lines, and a lateral displacement of a base of the rack assembly for movement of the vertical wall and therefore the hanger caddies from the position underneath a counter top to a position removed from under the counter top, as shown in dotted lines.

For use of the hanger caddy 10 of the present invention under a counter top 40 of a retail establishment, reference is made to FIGS. 5 and 6. In FIG. 5, a rack assembly 50 is shown. The rack assembly 50 includes a base 52 having upwardly projecting sidewalls 54, 56. The base 52 is intended to sit underneath a cash register 54 which is positioned on top of counter top 40.

Rollingly mounted on the base 52 is a tray including two triangular shaped rails 58, 60. The rails are interconnected with the respective sidewalls 54, 56 so that upon rotation of the rollers 58*a* through 58*e* and 60*a* through 60*e* the rails are movable on the base 52 to move from the position shown in solid lines of FIG. 6 to the position shown in dotted lines in FIG. 6, in the direction of arrow 62.

The two rails 58, 60 are interconnected by crossbar 64. Rotatably mounted on the crossbar 64 by hooks 66, is a wall 70 having two vertical bars 72, 74 as shown in FIG. 5 and two sets of crossbars 76*a*, 76*b* and 78*a*, 78*b*. The upper crossbars 76*a*, 78*a* of the sets of crossbars include a mounting bracket 80. The mounting bracket is L-shaped as shown in FIG. 6 so as to support section 12*f* of base 12 of the hanger caddy. The lower crossbars 76*b*, 78*b* of the sets of crossbars project from the bars 72, 74 as shown in FIG. 5 so as to support the sections 12*b*, 12*c* of the base of the hanger caddy 12.

As shown, the hanger caddy is elevated to an angle of approximately between 15 and 18 degrees. This elevation assists in the sliding of hangers down along the caddy when the hangers are placed on the caddy under the counter top 40 of a retail establishment.

For removal of hangers from the hanger caddies or removal of the hanger caddies from under the countertop 40, the caddies may be rolled out from under the countertop on the rails 58, 60 by pulling on U-shaped section 14*d* of the glide rod 14 to the position shown in dotted lines in FIG. 6. Easy access is thereby obtained to the hanger caddies.

For ease of shipment and storage, the wall 70 shown in a vertical orientation in FIGS. 5 and 6 may be folded down onto the base 52 by the release of ends 82*a*, 84*a* of the support bars 82, 84 which are pivotally mounted at upper ends 82*b*, 84*b* on the bars 72, 74. Pivoting around hook 66, 68, the wall 70 may be collapsed onto base 62. A reduction in overall height is thereby achieved which facilitates packing of multiple rack assemblies for storage and/or shipping.

As shown in FIG. 1, a hanger 90 having hanger hook 90*a* and shoulder or arm sections 90*b* and 90*c* is shown. The hanger hook 90*a* is positioned so as to be located between the assembly of secure wire 20 and section 14*b* of the glide rod 14 and hoop shaped section 22 of the guide rods 16, 18. The section 20*b* prevents the hanger hook 90*a* from being positioned other than in the orientation shown in FIG. 1, such that hangers 90 are dropped, when the hanger caddy 20 is in a vertical orientation as shown in FIG. 1 with the hanger hook 90*a* engaging or being guided-by glide rod 14 and secure wire 20 with arms 90*b* and 90*c* of the hanger engaging or being guided by guide rods 16, 18. Similarly, the hanger 90 engages the caddy 10, when the caddy 10 is angled as shown in FIGS. 5 and 6.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A hanger caddy for holding a plurality of hangers, each of said plurality of hangers having a hook and two arms, said hook including a curved portion, said hanger caddy comprising:

a base supporting the hanger caddy, a glide rod extending from said base, a secure wire for guiding of the curved portion of the hanger hooks between the glide rod and the secure wire as the hangers move toward the base, two guide rods extending from said base for guiding the hanger arms as the hangers move toward the base, said glide rod and said secure wire being movably mounted for adjusting a distance of the glide rod and the secure wire from the guide rods, and a mounting bracket of a tray assembly engaging said base.

2. The hanger caddy as claimed in claim 1, wherein said mounting bracket supports said glide rod at an elevation of between 15-18° when said mounting bracket is secured to a wall.

3. The hanger caddy as claimed in claim 1, wherein said tray assembly includes a wall pivotably mounted with respect to a bottom of the tray assembly.

4. The hanger caddy as claimed in claim 3, wherein the bottom includes sidewalls, rails connected to the wall are slidably mounted on the sidewalls.

5. The hanger caddy as claimed in claim 1, wherein the secure wire is mounted on the glide rod between opposite ends of the glide rod.

6. The hanger caddy as claimed in claim 5, wherein the opposite ends of the glide rod are adjustably secured to the base and the guide rods, respectively.

7. The hanger caddy as claimed in claim 6, wherein both of the opposite ends of the glide rod are separately adjustable with respect to the guide rods.

8. A system for sorting a plurality of hangers, each of said plurality of hangers having a hook and two arms, said hook including a curved portion, said system comprising:

a hanger caddy having a glide rod and a secure wire for guiding the curved portion of the hanger hooks therebetween and two guide rods variably spaced apart from said glide rod and said secure wire for guiding the hanger hooks, a mounting bracket supporting the hanger caddy at an inclined angle from a wall to which the hanger caddy will be mounted for enabling movement of the plurality of hangers along said glide rod, and said glide rod and said secure wire being movably mounted with respect to said guide rods, said wall being pivotably mounted on a base and the base being slidably mounted on a tray.

9. The system for sorting a plurality of hangers as claimed in claim 8, wherein said mounting bracket supports said glide rod at an elevation of between 15-18° when said mounting bracket is secured to the wall and the wall extends vertically from the base.

10. The system for sorting a plurality of hangers as claimed in claim 8, wherein the tray includes sidewalls and rails of the base are slidably mounted on the sidewalls.

11. The system for sorting a plurality of hangers as claimed in claim 8, wherein the secure wire is mounted on the glide rod between opposite ends of the glide rod.

12. The system for sorting a plurality of hangers as claimed in claim 11, wherein both of the opposite ends of the glide rod are separately adjustable with respect to the guide rods.

13. The system for sorting a plurality of hangers as claimed in claim 8, wherein the secure wire is spaced up to one-half inch from the glide rod.

14. A hanger caddy for holding a plurality of hangers, each of said plurality of hangers having a hook and two arms, said hook including a curved portion, said hanger caddy comprising:

a base supporting the hanger caddy, a glide rod extending from said base, a secure wire for guiding of the curved portion of the hanger hooks between the glide rod and the secure wire as the hangers move toward the base, two guide rods extending from said base for guiding the hanger arms as the hangers move toward the base, and said glide rod and said secure wire being movably mounted for adjusting a distance of the glide rod and the secure wire from the guide rods, the secure wire being mounted on the glide rod between opposite ends of the glide rod.

15. The hanger caddy as claimed in claim 14, wherein the opposite ends of the glide rod are adjustably secured to the base and the guide rods, respectively.

16. The hanger caddy as claimed in claim 15, wherein both of the opposite ends of the glide rod are separately adjustable with respect to the guide rods.

* * * * *